United States Patent [19]

Enos

[11] 4,170,851

[45] Oct. 16, 1979

[54] GRINDING MACHINE

[75] Inventor: Ellsworth C. Enos, Holden, Mass.

[73] Assignee: Cincinnati Milacron Heald Corp., Worcester, Mass.

[21] Appl. No.: 835,016

[22] Filed: Sep. 20, 1977

[51] Int. Cl.[2] ..... B24B 49/00

[52] U.S. Cl. ..... 51/165.71; 51/165.77; 51/165.93; 51/165.91

[58] Field of Search ..... 51/286, 291, 165.71, 51/165.92, 165.77, 165.8, 165.83, 165.93, 165.91

[56] References Cited

U.S. PATENT DOCUMENTS

| | | | |
|---|---|---|---|
| 3,305,978 | 2/1967 | Lumsden | 51/165.8 |
| 3,634,976 | 1/1972 | Hahn et al. | 51/165.71 |
| 3,634,978 | 1/1972 | Uhtenwoldt | 51/165.92 |
| 3,653,855 | 4/1972 | Smith | 51/165.77 |
| 3,663,189 | 5/1972 | Koide | 51/165.8 |
| 3,688,444 | 9/1972 | Uhtenwoldt | 51/5 |
| 3,741,071 | 6/1973 | Hoglund | 51/165.92 X |
| 3,867,794 | 2/1975 | Robillard | 51/165.77 |
| 3,893,676 | 7/1975 | Gloshinski | 51/237 R X |
| 3,916,576 | 11/1975 | Blackburn et al. | 51/165.74 |
| 3,977,126 | 8/1976 | Hohler | 51/5 D |

*Primary Examiner*—Harold D. Whitehead

*Attorney, Agent, or Firm*—Norman S. Blodgett; Gerry A. Blodgett

[57] ABSTRACT

Grinding machine for bearing races and the like in which a grinding plane extending transversely of the race axis is adjusted axially in accordance with variations in the end-to-end dimension of the race to provide a symmetrical track or groove of controlled width.

4 Claims, 12 Drawing Figures

GRINDING MACHINE

BACKGROUND OF THE INVENTION

The finishing of the track of a bearing race by grinding presents some difficult problems. This is particularly true in grinding the surfaces of the track of a roller bearing. Normally, the end of the race is located against the flat radial surface of a drive platen and the abrasive wheel is advanced axially to a point which is a fixed distance away from the platen. If the end-to-end dimension of all workpieces were the same, this would result in a track width and a lip thickness which are exactly the same from one workpiece to another. Unfortunately, the end surfaces of a finished bearing race are not critical either in their location or their finish, so that the end-to-end distance carries over a wide range of dimensions from one workpiece to another. When the conventional grinding system described above is used for processing tracks, therefore, the width varies from one workpiece to another. Since the width of the track is a critical dimension in the construction and operation of the bearing, this is unacceptable. One alternative that is available is to grind the end surfaces to a selected distance within a narrow range of tolerances. This, however, is not only expensive, but represents a waste of processing time, labor, and equipment, since perfectly acceptable bearings can be constructed when the end distances varies over fairly wide range of tolerances. Another alternative is to finish the radial surface of one lip and then reverse the workpiece and grind the radial surface of the other lip by inserting a gage that measures the distance between the lips continuously and allows the advance of the grinding operation on the second lip to take place only until the gage indicates that the proper width has been arrived at. Not only is this difficult to do, because of the presence of the gage in the workpiece while the grinding is progressing, but it requires expensive, delicate instrumentation. Furthermore, it produces lips that are different in their thickness, even though the width of the track is the selected one within a narrow range of tolerances. These and other difficulties experienced with the prior art devices have been obviated in a novel manner by the present invention.

It is, therefore, an outstanding object of the invention to provide a grinding machine for producing perfectly centered tracks and grooves on bearing races.

Another object of the present invention is the provision of a grinding machine for producing roller tracks in roller bearing races in which the track has a width which is accurate to a high degree of tolerances, despite variations in the end-to-end dimension of the workpieces.

A further object of the present invention is the provision of a grinding machine for producing a track on a bearing race that is perfectly centered in the end-to-end dimension.

It is another object of the instant invention to provide a method of grinding perfectly centered tracks on a bearing race to a predetermined width.

A still further object of the invention is the provision of a method of grinding a bearing race track within a predetermined tolerance of width and the lip thickness.

It is a further object of the invention to provide a method of grinding tracks on bearing races in such a way that they are accurately formed and located, despite wide variations in the end-to-end dimensions of the rough workpieces.

It is a still further object of the present invention to provide a grinding machine for forming in bearing races grooves and tracks of good quality and location, which grinding machine is simple in constructions, inexpensive to manufacture, and which is capable of a long life of useful service with a minimum of maintenance.

Another object of the invention is the provision of a method of grinding bearing race grooves which are accurately formed without the necessity of maintaining small tolerances on the end-to-end dimension in previous production steps.

With these and other objects in view, as will be apparent to those skilled in the art, the invention resides in the combination of parts set forth in the specification and covered by the claims appended hereto.

SUMMARY OF THE INVENTION

In general, the invention resides in a grinding machine for finishing a radial surface on a workpiece having major surfaces of revolution and having parallel radial end surfaces whose spacing varies from workpiece to workpiece within a wide range of tolerances. The grinding machine is provided with a base on which is mounted a workhead for supporting the workpiece and rotating it about a workpiece axis which is perpendicular to the said radial end surfaces. A wheelhead is mounted on the base and carries an abrasive wheel with a radial surface for rotation about a wheel axis which is either parallel with or inclined to the said workpiece axis. Feed means is provided to bring about relative feed movement between the workhead and the wheelhead cause the said radial surface of the wheel to grind the radial surface of the workpiece which is to be defined. A gage is provided for measuring the distance between the end radial surfaces of the workpiece. A control is provided for determining the difference between the said measured distance and the corresponding distance between the radial end surfaces of a standard workpiece, the control obtaining one-half the said difference and causing the said feed means to produce the feed movement in an amount equal to a predetermined amount adjusted by the said one-half of the said differences.

The invention also includes a method of grinding the spaced parallel radial surface of a roller track for the race of a roller bearing, the race having parallel radial end surfaces whose spacing varies within a range of tolerances. The method consists of placing one end surface of the race in a first plane and rotating it about its axis and then measuring the distance from the said one radial end surface to the other radial end surface. A determination is made of the difference between the said distance and the corresponding distance between the radial end surfaces of a standard race. The method includes feeding a grinding wheel having a radial surface axially toward one of the radial surfaces of the track, the feeding taking place in an amount equal to a predetermined feed amount (commensurate with the said standard race) to which is algebracially added or subtracted a feed amount equal to one-half the said difference. The race is then reversed end-to-end so that the said other radial end surface is located at the said first plane and then repeating the steps of measuring and determining the difference and then feeding the grinding wheel toward the other of the radial surfaces of the path in the same amount as before. This assures that the radial surfaces of the track are not only accurately spaced, but also are symmetrical of the track, and that the lips of the race are of equal thickness.

More specifically, the apparatus has means for introducing a series of similar workpieces successively to the workhead for grinding and means is provided to actuate a gage to make the said measurement during the period of time between the time that the workpiece is established on the workhead and the time the grinding is begun. The feed means includes a stepping motor operated by electrical pulses, a digital display means that can be set to supply a predetermined number of pulses to the stepping motor to cause the said predetermined feed movement. The gage emitting a digital signal indicative of the said distance, a logic circuit receiving the said gage signal deriving the difference between the said signal and the signal commensurate with the said standard workpiece and adding or subtracting the said difference from the said predetermined feed movement which has been set on the digital display means.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
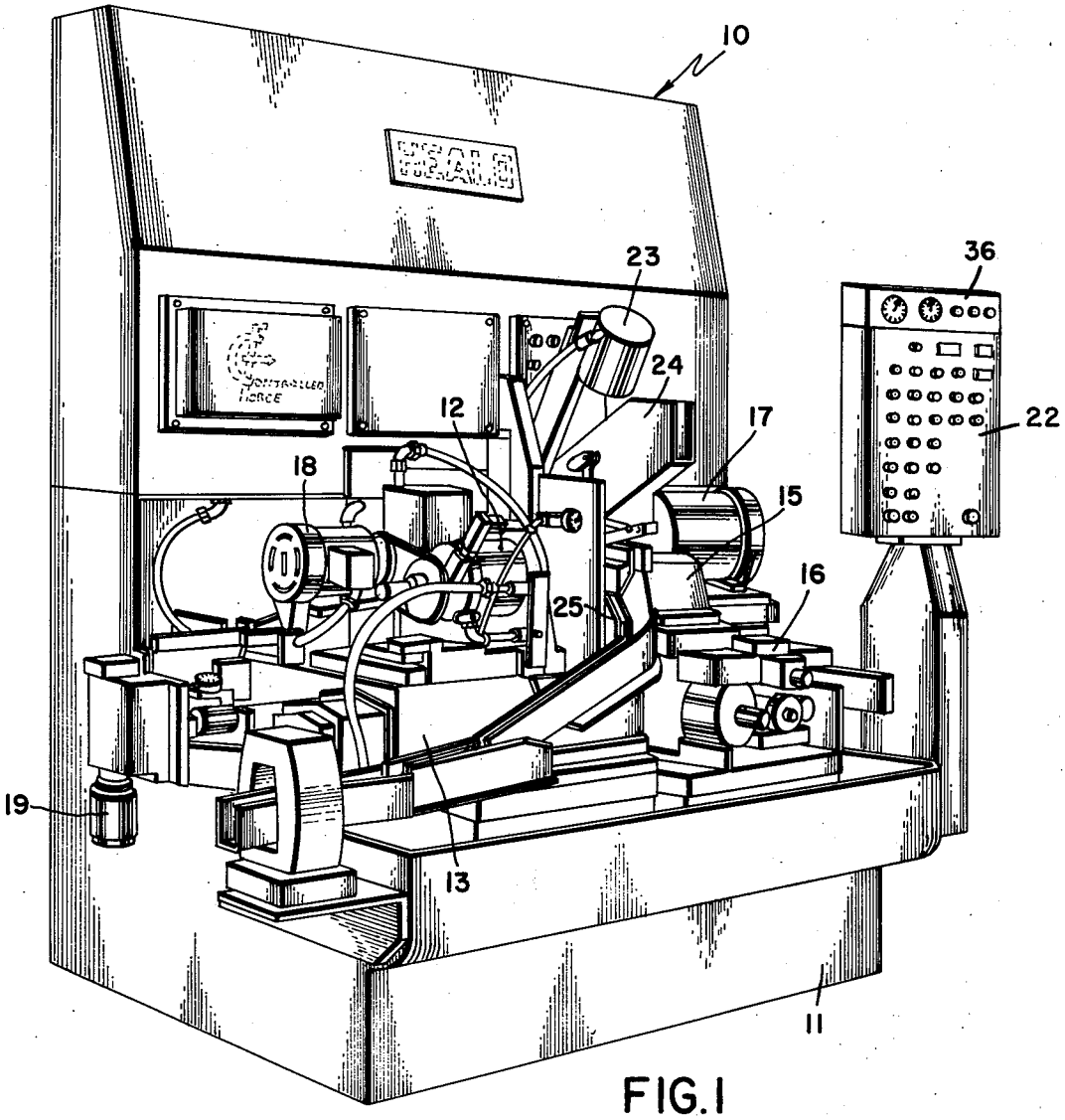
FIG. 1 is a perspective view of a grinding machine embodying the principles of the present invention.

Referring first to FIG. 1, wherein are best shown the general features of the invention, the grinding machine, indicated generally by the reference numeral 10, is shown as having a base 11 on which is mounted a workhead table 13 carrying a workhead 12. Also mounted on the base is a wheelhead table 16 carrying a wheelhead 15. The wheelhead motor 17 is connected to the wheelhead 15 to drive it, while a workhead motor 18 drives the workhead 12. The workhead table 13 is mounted on longitudinal slides 14 (see FIG. 2) and is capable of fine feed motion in the longitudinal direction provided by means of a stepping motor 19. The grinding machine is provided with a gage 21 (see FIG. 4) and a control box 22. A dresser motor 23 is provided. An input chute 24, and an output chute 25 are connected in suitable positions in the machine.

Figure 2:
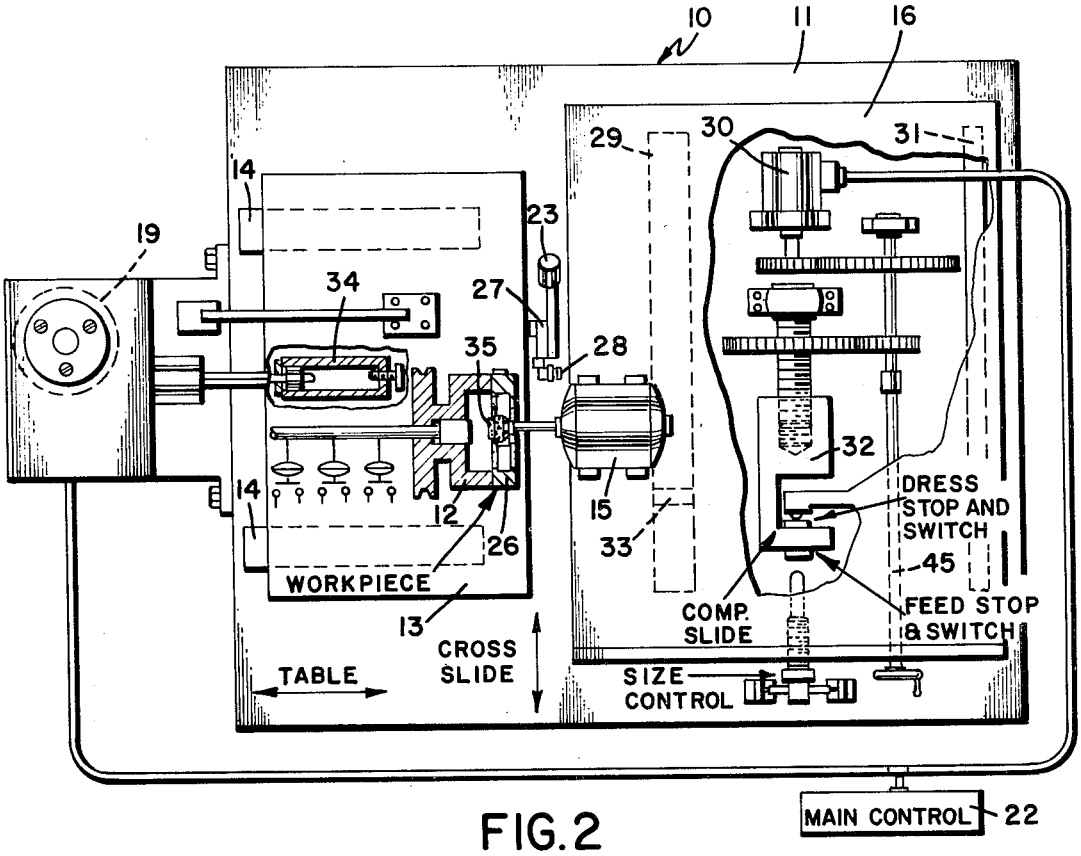
FIG. 2 is a schematic view of the important operative elements of the machine.

FIG. 2 shows the manner in which the workhead table 13 is capable of sliding motion on ways 14 extending parallel to the axis of a surface of revolution of a workpiece 26 which has various surfaces to be finished. A dressing apparatus 27 is provided having a diamond-studded wheel 28.

The wheelhead table 16 is mounted on ways 29 and 31, so that it can move transversely of the axis of the surface of revolution of the workpiece 26. Both the table 16 and the table 13 are movable under the impetus of hydraulic linear actuators 33 and 34 to produce gross motions at certain parts of the the grinding cycle. Lying on the base 11 and slidable over its surface is a compensation slide 32. A crossfeed stepping motor 30 operates on the compensation slide 32 and, eventually, on the wheelhead table 16 to bring about transverse feed of the abrasive wheel 35 toward the workpiece surface to be finished.

Figure 3:
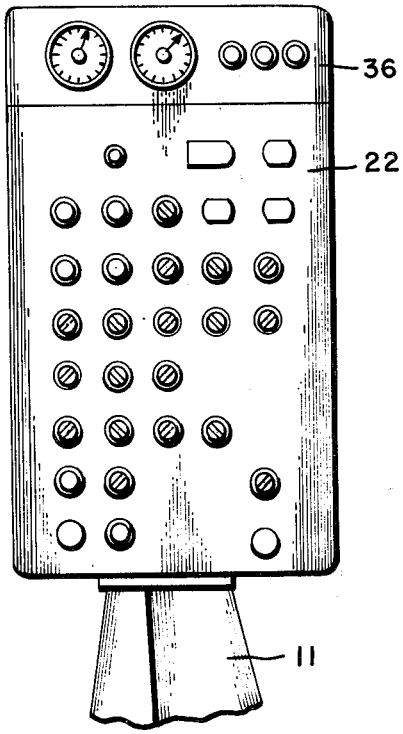
FIG. 3 is a vertical elevation of the control panel of the machine.

FIG. 3 shows the control box 22 mounted on a pedestal arising from the base 11. A supplemental control panel 36 is mounted at the top and is suitably electrically connected to the control panel 22.

Figure 4:
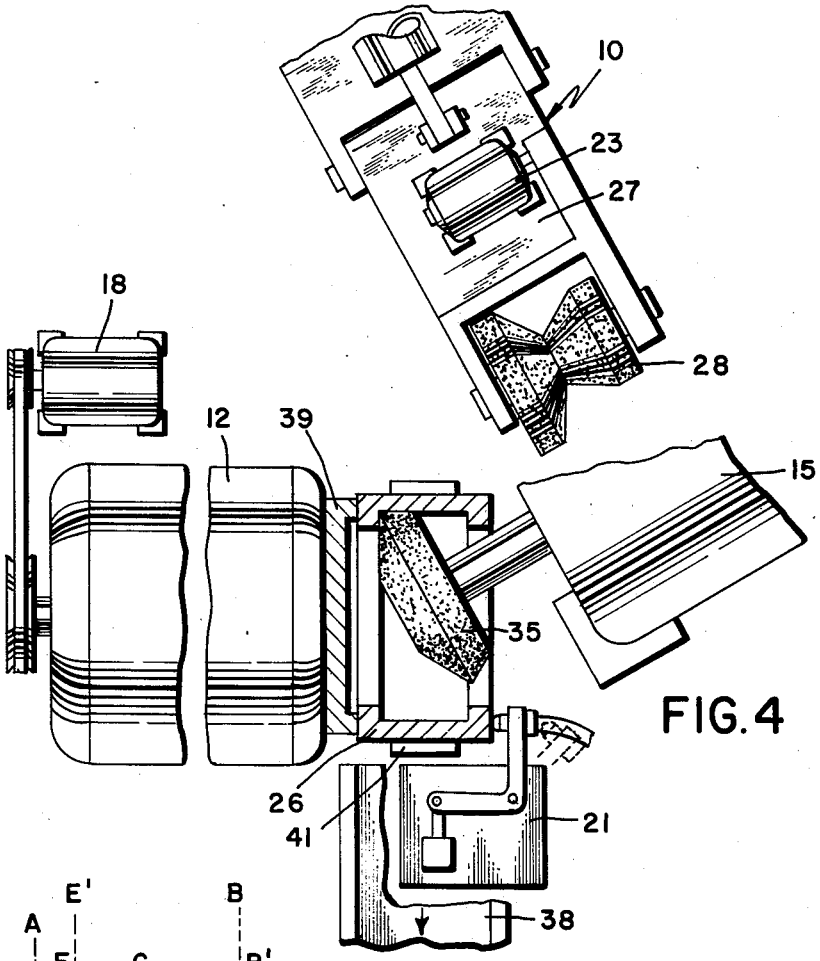
FIG. 4 is a plan view partially in section of the operating portion of the machine.

FIG. 4 shows the relationship of the parts during the grinding cycle. The dressing apparatus 27 with the formed diamond dressing wheel 28 is similar in nature to the apparatus shown in the U.S. Pat. of Hohler et al No. 3,977,126. The input loading chute 24 (FIG. 1) delivers from the front of the machine, while the output chute 25 is also directed toward the front. The loading apparatus is similar to that shown in the U.S. Pat. of Uhtenwoldt et al No. 3,657,843. Mounted on the front of the machine is a gage 21 which swings toward and away from the end of the workpiece 26 in the manner shown and described in the U.S. Pat. of Uhtenwoldt et al No. 3,688,444; a similar gage is shown in the U.S. Pat. of Blackburn et al No. 3,916,576. The gage produces a digital readout in the manner described in the above-mentioned Blackburn et al patent. The workhead 12 is provided with a platen 39 which engages the left-hand end of the workpiece 26. This platen is of the magnetic drive type shown and described in the U.S. Pat. of Gloshinski et al No. 3,893,676, which patent also shows the nature of the shoes 41 which engage the outer periphery of the workpiece and serve to support it during the grinding operation.

The grinding machine 10 is of the general type which operates on the controlled-force principle during the roughing portion of the grinding cycle and operates with a digital feed rate advance during the finish portion of the cycle. Such a machine is shown in the U.S. Pat. of Uhtenwoldt et al No. 3,657,843. The nature of the longitudinal and transverse stepping feed is shown and described in the U.S. Pat. of Hahn et al No. 3,634,976, as well as the U.S. Pat. of Uhtenwoldt et al No. 3,634,978, wherein the surface of revolution of the workpiece is inclined to the axis of the wheelhead spindle.

Figure 12:
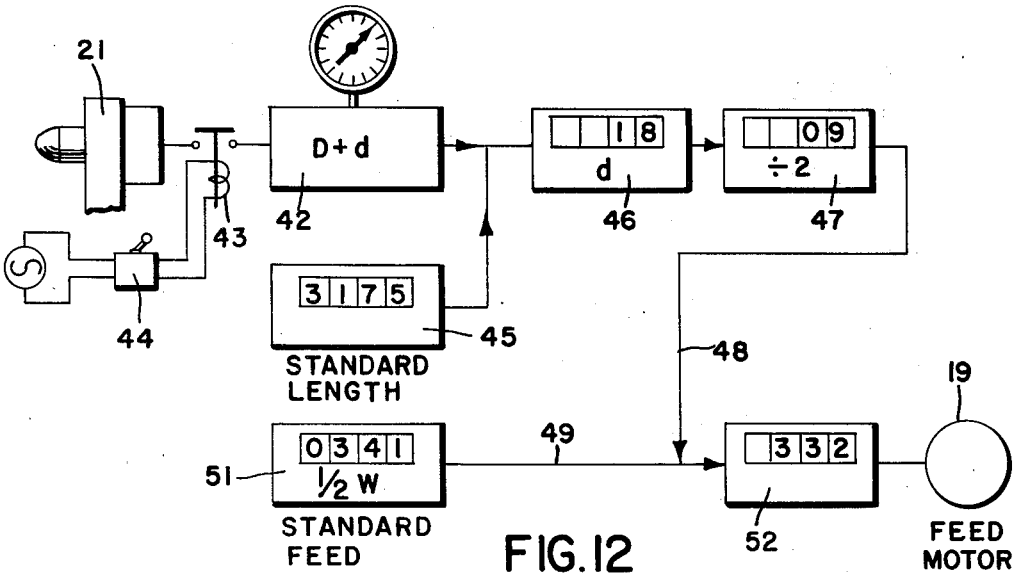
FIG. 12 is an electrical schematic view of a portion of the machine.

FIG. 12 shows the details of the controls, including the gage 21. The digital signal from the gage 21 is connected to an analog-to-digital converter 42 by the contacts of a relay 43. This relay is actuated to close its contacts by the operation of a limit switch 44 at a suitable time in the cycle. The digital setting from a standard length digital switch 45 to produce a difference reading "d" at a read-out 46. The magnitude of the signal emitted from the read-out 46 is divided in two by the element 47. This signal is fed through a line 48 to a line 49 which receives a signal from a standard feed digital switch 51. The two signals on the lines 48 and 49 are combined in the element 52 and serve in the conventional way to control the number of pulses being fed to the feed motor 19.

Figure 6:
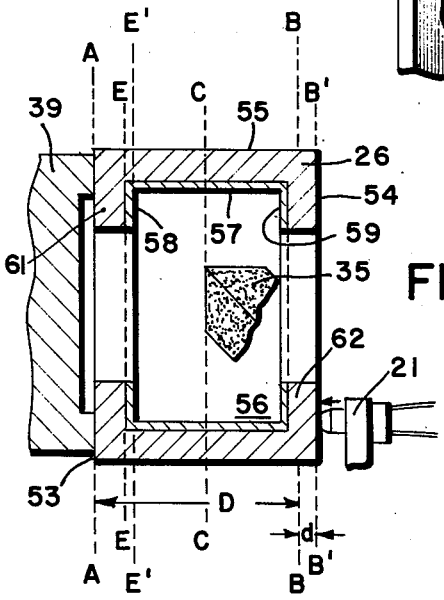
FIGS. 6, 7, 8, 9, 10, and 11 show the various steps of the method of the invention.

The operation of the present invention will now be readily understood in view of the above description, particularly in connection with FIGS. 6–11 with the grinding machine 10 operating in the conventional way, the workhead motor 18 operates through the workhead 12 and the platen 39 to rotate the workpiece 26 about the axis of the cylindrical surface which is to be generated. Referring to FIG. 6, the workpiece 26 is shown as the outer race of a roller bearing. As such, it has a first end radial surface 53 which is engaged by the platen 39 and a right-hand end surface 54 which is engaged on occasion by the gage 21.

The workpiece 26 has an outer cylindrical surface 55 which rests in the shoes 41. The workpiece also has an inner groove 56 whose surface is to be finished, this groove having a cylindrical bottom surface 57, the left-hand radial end surface 58, and a right-hand radial end surface 59. Finally, the workpiece has a lip 61 defined by the two radial surfaces 53 and 58 and a lip 62, defined by the radial surfaces 54 and 59.

Figure 5:
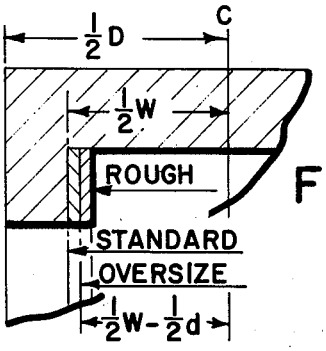
FIG. 5 is a schematic view showing various geometric relationships in the workpiece.

In FIG. 6 the abrasive wheel 35 is located (in an exaggerated position) illustration as having its radial operative surface lying on a mid line C—C relative to the contact surface of the platen 39. The end surface 53 lies in the plane A—A which is the engaged surface of the platen 39. The other end surface 54 of the workpiece can vary in a range from the plane B—B to the plane B'—B'. The plane B—B is the plane in which the end surface 54 of a standard perfect workpiece would lie and this would lie at a distance "D" from the plane A—A. The distance between the plane B—B of the standard workpiece and the plane B'—B' of an actual workpiece (within tolerances) is the distance "d". In the same way, the plane E'—E' is the plane of the groove end surface 58. The plane E—E is the plane of the groove end surface 58 of a finished standard workpiece. The plane E—E is the plane to which the end surface is to be finished in order to, first of all, make the end surfaces 59 and 58 exactly symmetrical of the center of the workpiece and, secondly, having an exact predetermined width or distance between them. This relationship is clearly shown in FIG. 5. The gage 21 in actuation causes the terminal position of the platen 39 to be laterally adjusted so that mid-line CC is correctly positioned relative to the grinding wheel 35, which adjustment is one-half the adjustment "d". This distance is, of course, one-half the difference between the actual end-to-end length of the workpiece and the length of the standard workpiece.

Figure 7:
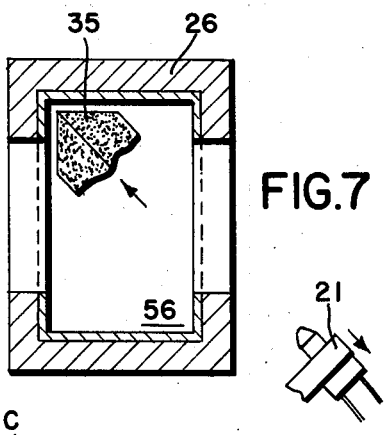

In FIG. 7 the wheel 35 advances toward the corner of the groove 56. It will be understood, of course, that in actuality the workpiece 26 is moved toward the abrasive wheel 35 by the stepping motor 19, but, for the purpose of clarity, the description will follow as though it were the wheel that moves. At this time, the gage 21 is located away from the workpiece.

Figure 8:
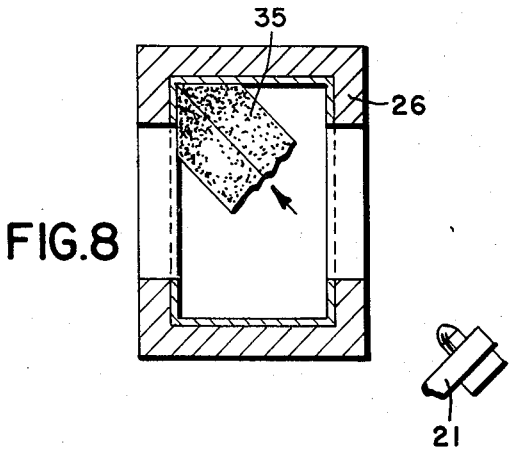

In FIG. 8 it can be seen that the abrasive wheel 35 had made contact with the groove, the amount of longitudinal feed being one-half the desired width W of the finished groove.

Figure 9:
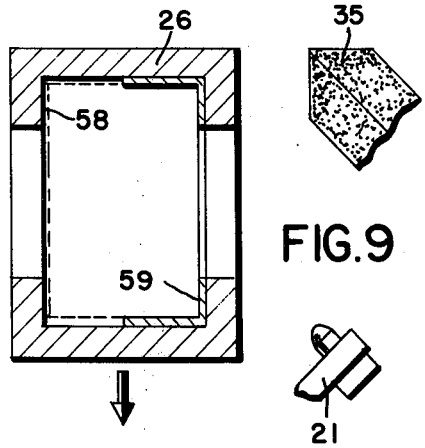
Figure 10:
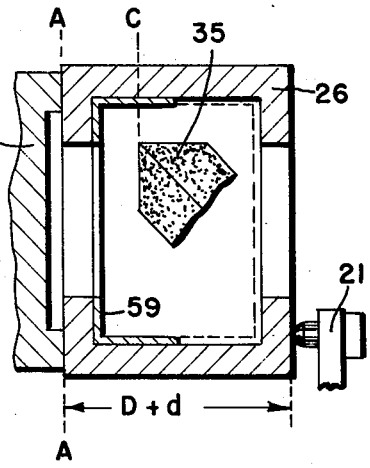
Figure 11:
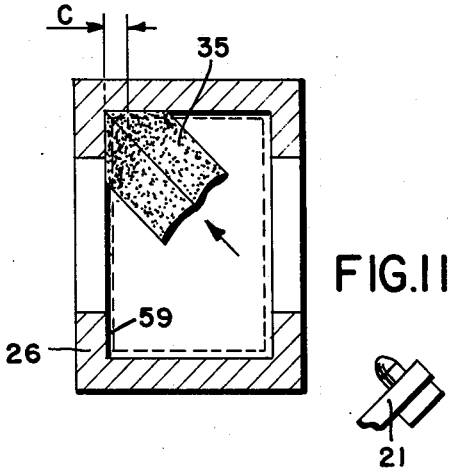

In FIG. 9 the wheel 35 is shown removed from the workpiece, so that the workpiece can be removed from the machine and reversed in its position. In FIG. 10 the workpiece is shown reversed with metal remaining at the other end of the groove which needs to be removed. The gage 21 is shown in engagement with the workpiece making the measurement again. Finally, in FIG. 11 the wheel is shown grinding the end surface 59.

It can be seen, then, that the present invention involves grinding the spaced-parallel radial surfaces of a roller path or track for the race of a roller bearing by placing one end surface of the race in a first plane and rotating it about its axis. The distances then measured from the said one radial end surface to the other radial end surface of the workpiece and the difference determined between the said distance and the corresponding distance between the radial end surfaces of a standard race. The grinding wheel is then fed with its radial surface moving axially toward one of the radial surfaces of the groove. The feeding takes place in an amount equal to a predetermined fed amount commensurate with the said standard race to which is algebracially added or subtracted a feed amount equal to one-half the said difference.

In this way the track or groove in the race will be exactly symmetrical to the mid-plane of the race, irrespective of its length within the acceptable tolerance. At the same time, the track width will be exactly as decided to any given degree of accuracy and this will result in the lips on the track being exactly the same width or thickness. As described above, the machine that provides this function is relatively simple in construction, since the critical movements are taking place by means of stepping motors which are controlled from digital control apparatus making use of electrical pulses for the arithmetic computations. The digital equipment for controlling the stepping motors is of a conventional type which can be readily purchased and requires no special designs.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Grinding machine for finishing a radial surface on a workpiece having parallel radial end surfaces whose spacing varies within a range of tolerance and which are parallel to said radial surface, comprising:

(a) a base, (b) a workhead mounted on the base for supporting the workpiece so that one of said radial end surfaces is located at a fixed location and for rotating it about a workpiece axis perpendicular to the said radial surfaces, (c) a wheelhead mounted on the base and carrying an abrasive wheel with a radial surface for rotation about a wheel axis, (d) feed means bringing about relative feed movement between the workhead and the wheelhead to cause the said radial surface of the wheel to grind the radial surface of the workpiece, (e) a gage for measuring the distance between the radial end surfaces of the workpiece, and (f) a control for determining the difference between the said measured distance and the corresponding distance between the radial end surfaces of a standard workpiece, obtaining one-half the said difference, and causing the said feed means to produce the feed movement in a direction parallel to said workpiece axis in an amount equal to a predetermined amount adjusted by the said one-half the said difference.

2. Grinding machine as recited in claim 1, wherein means is provided for introducing a series of similar workpieces successively to the workhead for grinding, and wherein means is provided to actuate the gage to make the said measurement during the period of time between the time that the workpiece is established on the workhead and the time the grinding is begun.

3. Grinding machine as recited in claim 1, wherein the workhead is provided with a drive platen having a surface extending transversely of the workpiece axis against which said one radial end surface of the workpiece is located during grinding, the gage operating on the other end surface of the workpiece when the said one radial end surface is so located.

4. Grinding machine as recited in claim 1, wherein the feed means includes a stepping motor operated by electrical pulses, a digital display means that can be set to supply a predetermined number of pulses to the stepping motor to cause the said predetermined feed movement, the gage emitting a digital signal indicative of the said distance, a logic circuit receiving the said gage signal, deriving the difference between the said signal and a signal commensurate with the end-to-end distance of the standard workpiece, dividing the said difference by two, and adding or subtracting the results from the predetermined number of pulses to obtain the actual feed.

* * * * *